United States Patent [19]

McClure, III

[11] 4,051,846

[45] Oct. 4, 1977

[54] LIFE SUPPORT SYSTEM FOR DIVERS

[76] Inventor: Clifton M. McClure, III, 7228 Governors Drive, Huntsville, Ala. 35805

[21] Appl. No.: 654,469

[22] Filed: Feb. 2, 1976

[51] Int. Cl.[2] ..... A62B 7/02

[52] U.S. Cl. ..... 128/142 R; 128/142.4; 61/70

[58] Field of Search ..... 128/142 R, 142.2, 142.3, 128/142.4, 142.5, 142.7, 145 R, 145 A, 147, 204, 203; 61/70 R, 69 R; 114/16 E, 16.4

[56] References Cited

U.S. PATENT DOCUMENTS

| | | | |
|---|---|---|---|
| 836,892 | 11/1906 | Pulliam | 114/16 E |
| 3,269,129 | 8/1966 | Zambrano | 61/70 |
| 3,605,418 | 9/1971 | Levine | 114/16 E |
| 3,866,253 | 2/1975 | Sinks et al. | 128/142 R |
| 3,967,459 | 7/1976 | Denis | 128/142 R |

*Primary Examiner*—Robert W. Michell
*Assistant Examiner*—Henry J. Recla
*Attorney, Agent, or Firm*—C. A. Phillips

[57] ABSTRACT

An emergency ascent system to be used by a diver in conjunction with a pressurized breathing system. Responsive to a valve operated by the diver, air pressure is applied to a first end of a cylinder, and a piston therein is moved from the first end to a second end, ejecting a counter buoyancy weight, and causing the applied air pressure to be valved to an air bag, which is inflated thereby to effect the ascent of the diver.

7 Claims, 7 Drawing Figures

LIFE SUPPORT SYSTEM FOR DIVERS

BACKGROUND OF THE INVENTION

1. Field of the Invention

This invention relates to life support systems used by divers, and particularly to a system which will positively effect the ascent of a diver.

2. General Description of the Prior Art

The rising death toll from diving accidents, particularly among sports divers, attests to the fact that additional safeguards are needed. Time after time divers become disabled and die below before they can be brought to the surface. The problem is most acute with amateur divers engaged in scuba diving, where typically there is no communication between the diver and anyone else who might assist him. While it appears that a diver faced with an immediate need to return to the surface could, with assurance, perform the maneuvers required with existing equipment to increase his buoyancy to achieve ascent, it is clear from the failures that have occurred that, in an emergency, many find the maneuvers difficult, and some, unfortunately, find them impossible.

To better appreciate the problem, one should assume the position of a diver who suddenly realizes that he needs to surface. First, there is the decision as to whether to simply swim up; whether to add buoyancy by inflating, or further inflating, an air bag; or whether to both release weights an inflate an air bag (both items are usual equipment carried by divers). Just the decision process alone takes time, during which the situation may deteriorate. If one elects to swim up, this may be too slow and produce an acute emergency, during which time one has even less time to further decide and to take one or both of the other steps. Actually, it is clear that a diver should take both steps and should release his weightsfirst, which will have the greatest effect. We will assume next that one has correctly made the decision to release weights first. The weights, counter buoyancy weights, are selected by a diver to counter his own weight and enable him to normally descend in the water at a desired rate and are typically carried either by a belt or are attached to the rear or sides of a diver's backpack carrying his breathing equipment. If attached to the backpack, it becomes necessary to release a pin or pins or velcro strips securing the weights. Typically, this operation must be performed by feel as vision is restricted or blocked. Further, since a diver seldom has occasion to release weights, hopefully never, his performance of this function may be awkward and, at worst, ineffective. If, and this is a quite typical case, the weights are carried on a belt, the diver must determine which of two or three belts are to be shed and then unbuckle the right belt. He then must hold it free of his body and his other equipment so that the weights and belt will not become entangled and will fall free. Assuming one has been successful in achieving the release of weights, and in order to further assure ascent at a desired rate and to achieve a maximum positive buoyancy on the surface, one should then inflate the inflatable bag. Here again a decision is required. Inflation may be achieved by one or the other of two methods. In one, the diver employs an "inflate" mouthpiece, and by alternately breathing from his normal breathing mouthpiece and then changing over to the "inflate" mouthpiece and breathing into it, he can slowly inflate the air bag. More properly, he should operate open a valve between his air tank and bag and directly inflate the bag. The difficulty is that there are two separate valves, one for each method. Thus, there is the reasonable chance that in an emergency one will become confused and operate the wrong valve; or worse, the manual valve may be operated improperly, causing deflation.

While the operations discussed are not particularly difficult when one has all of his faculties and has sufficient time to act, such is typically not the case when an amateur diver gets into difficulty and suddenly realizes that he may drown. Quite likely he will panic, and in such a state, he simply cannot be depended upon to go through the thought and mechanical procedures outlined above for the release of weights and inflation of his air bag.

While a variety of situations requiring ascent may arise, perhaps the most frequent one which results in an emergency is the loss of air, and not infrequently this occurs because of the simple failure by one to check air pressure until it is too late. It is too often first realized when one attempts to take a breath and cannot. It can be readily appreciated that this produces panic, or near panic. To make it worse, the diver has no air left to inflate air bags and must completely rely upon his rapidly performing the necessary maneuvers to relieve and clear his body of the weights which are attached to him. The fact that bodies of divers are often recovered with weights still attached attests to the fact that improvement are needed.

It is, accordingly, the object of this invention to materially improve life support systems for divers in a manner which will significantly reduce the effort, both mental and physical, required to effect an ascent.

SUMMARY OF THE INVENTION

In accordance with the invention, a diver's backpack would include at least one cylindrical chamber or cylinder which would carry a weight or weights to be released for emergency ascent. A piston would normally be positioned at a first end of the cylinder and an ejectable cap at the opposite end. Gas pressure, typically air, would be supplied, through a readily accessible control valve, to the piston end of the cylinder; and upon operation of the valve, the piston would apply a downward force on the weights which would in turn apply a force upon the ejectable cap. The cap would include release means responsive to this pressure to cause the cap to be freed from the end of the cylinder, allowing weights and cap to be ejected.

As a further feature of the invention, the weights (including any spacers) would fit snugly between the piston and release means so that only a slight movement of the piston would be sufficient to release the cap. Coordinate with this, air would be fed from the diver's air system through a check valve and a length of line to the control valve which will effect a storage of air pressure. This assures a source of operating air pressure even if the diver's normal air supply becomes exhausted or fails.

As still a further feature of the invention, stop means would be provided at the ejection end of the cylinder to prevent the piston from being ejected and enabling the piston to close and to provide a pressure seal at the end of the cylinder. The pressure thus built up would be provided through a port in the cylinder to an inflatable bag forming a portion of the backpack.

DETAILED DESCRIPTION OF THE DRAWINGS

Figure 1:
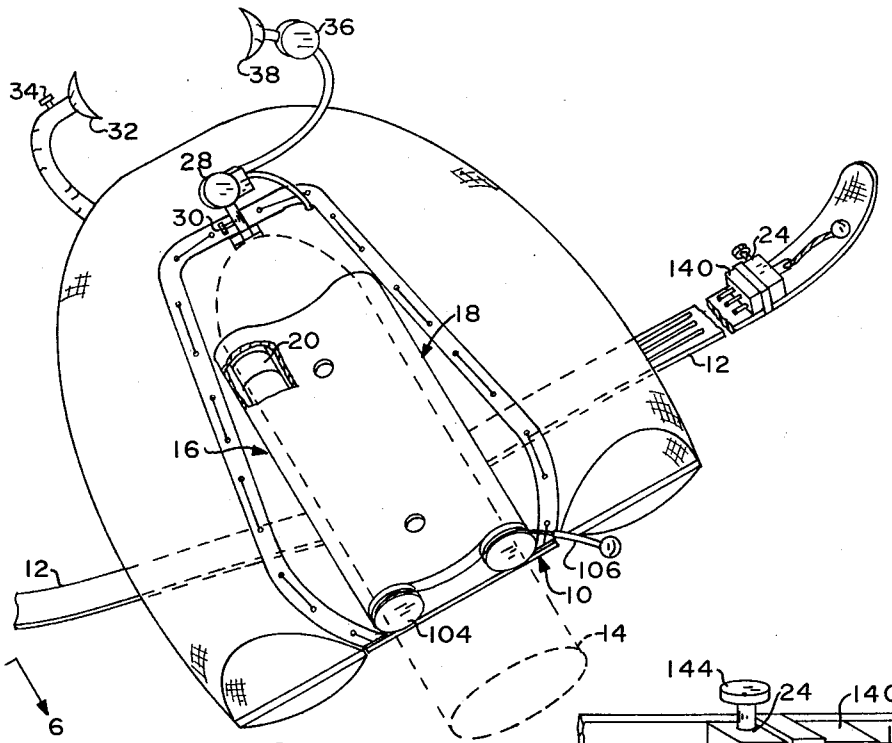
FIG. 1 is a pictorial view of a diver's backpack of the geneal configuration employed in an embodiment of the present invention and illustrating a typical position of the control valve for controlling the operation of this invention.
Figure 4:
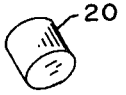
FIG. 4 is a pictorial view of a weight member employed with this invention.
Figure 2:
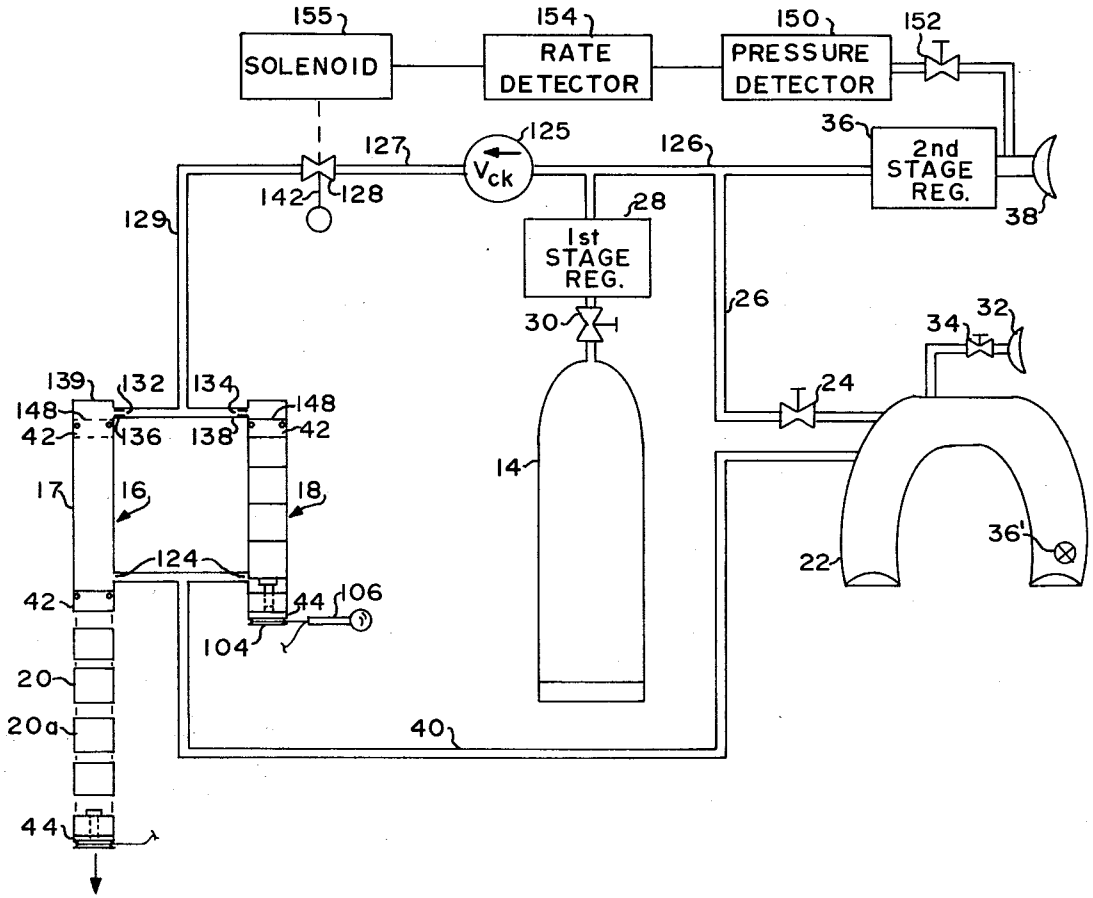
FIG. 2 is a schematic illustration of the system of this invention.

FIGS. 1 and 2 illustrate the functional system and arrangement of the components of the system of this invention. As shown in FIG. 1, the system is adapted to strap on the back of a diver and is generally referred to as a backpack. It includes frame 10 contoured on the underside to comfortably fit the back of the diver and is strapped on by a conventional harness, a waistband portion 12 of same being shown. The frame is centrally contoured so as to accept an air tank illustrated in dotted lines 14 in FIG. 1. A pair of canistors 16 and 18 are mounted to frame 10 and are sized to carry a number of cylindrical lead weights, one of which is shown in FIG. 4. The sum of the weights used is such as to achieve a desired degree of negative buoyancy to enable a diver to descend at a desired rate. In order to fill up the cavity of a canister or cylinder 16 or 18 when less then a full load of weights is required, dummy weights, typically constructed of wood or plastic, are added. As an offset to weights and to further adjust buoyancy, and particularly to assist ascent, the backpack includes an inflatable horseshoe-shaped bag 22 which is attached to frame 10. Bag 22 is inflatable either through valve 24, line 26, regulator 28, and valve 30 from tank 14 or by means of mouthpiece 32, which through valve 34 enables one to orally inflate the bag. Bag 22 typically includes a 2–4 PSI relief valve 36' which prevents overinflation of the bag. Typically, a diver would enter the water with the bag inflated, and then by means of valve 34, would partially deflate bag 22 until a desired negative buoyancy is effected, taking into account the body of the diver, the weights in canisters 16 and 18, and the bouyancy provided by bag 22.

Tank 14 typically would be initially pressurized to a pressure between 2,200 PSI and 3,000 PSI and would be connected through a master valve 30 to first stage regulator 28 which would reduce the pressure down to approximately 150 PSI (80–200), and as thus reduced would be fed to a second stage regulator 36 which would reduce pressure down to ambient at breathing mouthpiece 38 to enable comfortable breathing by the diver. The weight-holding canisters in a conventional backpack (similar in outward appearance to the one shown) would be closed at the bottom by a plate or plug with one or two release pins which the diver would have to pull free in order to release the weights, and then he would have to be standing upright so that gravity would release them. Effective release would also depend upon how freely they came out of the canisters. Thus, there could be no binding or corrosion which would interfere with their dropping out. In practice, it has been found that a diver normally not needing to release the weights, not having been faced with an emergency situation, tends to leave them in place for long periods of time, during which they can become corroded and will not readily come out when needed.

Figure 5:
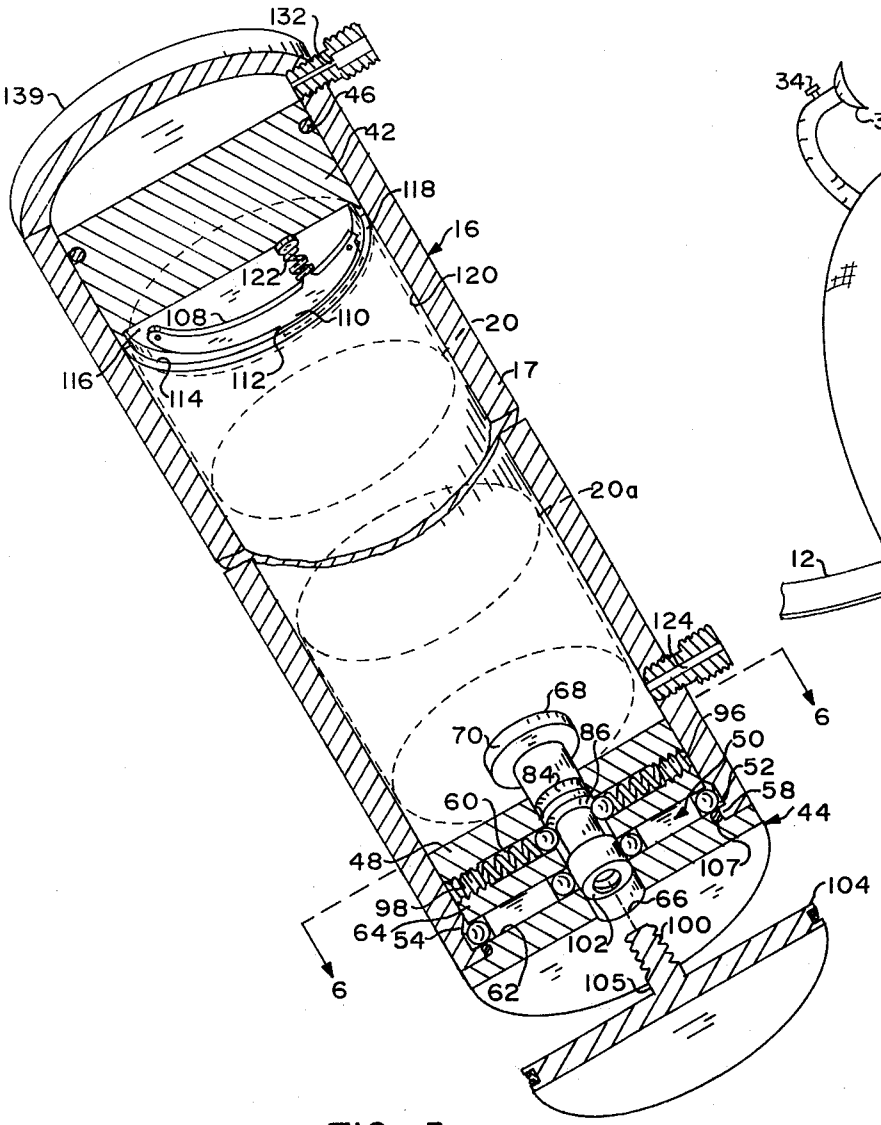
FIG. 5 is a pictorial view, partly in section, of a weight-holding cylinder contemplated by this invention.

In accordance with the invention, canisters 16 and 18 would be constructed as cylinder 17, illustrated in FIGS. 1 and 5, and bag 22 would be additionally supplied a source of air, selectively, as will be explained, by a second line 40, connected between cylinder 17 and bag 22.

Cylinder 17 is loaded with selected weights which are stacked between free sliding piston 42 at the upper end and by a disposable cap 44 which is sealably inserted in the lower end of cylinder 17. Piston 42 is sized to closely fit the inner wall of cylinder 17 and is provided with an "O" ring seal 46 so as to provide a gas-tight seal within cylinder 17.

Disposable or ejectable cap or cap assembly 44 includes an annular body 48 which is sized to slidably engage the inner wall of cylinder 17 and includes a ball-type lock assembly 50 which engages the lower edge of cylinder 17. A circular notch 52 is formed inward of the inner periphery of cylinder 17, with one edge 54 tapered toward the closed end of the cylinder, and a lower edge 56 formed normal to the inner wall of the cylinder so as to provide a lip 58 about the inner periphery of cylinder 17. Spaced lateral holes 60 and 62 are formed through central portion 64 of cap 44, and these interconnect with central axial hole 66.

Figure 6:
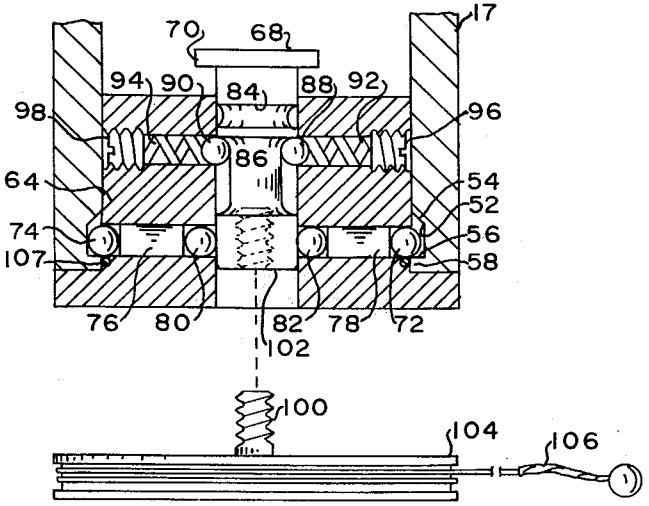
FIG. 6 is a sectional view of a lower portion of the cylinder shown in FIG. 5 when in a locked mode.

A cap locking and releasing pin 68 is slidably engaged through hole 66, being limited in travel by an enlarged shoulder 70. Cap 44 is locked into position as shown in FIG. 6 by steel balls which are engaged with circular slot 52 formed in cylinder 17. Balls 72 and 74 are urged into a locking position through actuating pins 76 and 78 and inner balls 80 and 82 which connect with release pin 68. Cap release pin 68 is axially positioned by detent slots 84 and 86 which are formed in the central region of release pin 68. Detent balls 88 and 90 are urged into firm contact with release pin 68 by springs 92 and 94, supported at the outer end by set screws 96 and 98. Weights 20 positioned within canister 16 are supported by release pin 68. Accordingly, when pressure is applied at the upper end of it by weights 20, in turn acted upon by piston 42, in a manner to be further described, pin 68 is pushed downward into a release position. This causes cap 44 to be released and to be ejected.

Should the pressure release mechanism fail, a mechanical release is provided in the form of a threaded screw 100 which is threaded into mating threads centrally formed in lower end 102 of release pin 68. A grooved rotating pulley 104 is secured at the outer end and head 105 of screw 100, and a flexible wire is wound in the groove such that a force applied to an emergency pull cord 106 would rotate the pulley, and thus screw 100 to release pin 68. This in turn would unlock cap 44 and enable the cap and weights to drop out under the force of gravity. As will be noted in FIG. 1, pull cord 106 would be connected between screws 100 in each cap in each cylinder, and thus a relatively simple operation, merely pulling outward on cord 106, would provide an unscrewing force on both of screws 100 to thus unlock the caps of both cylinders 16 and 18 (FIG. 2). The employment of this auxiliary release system would, of course, be a most unusual situation in view of the effectiveness of the pressure release system.

Figure 7:
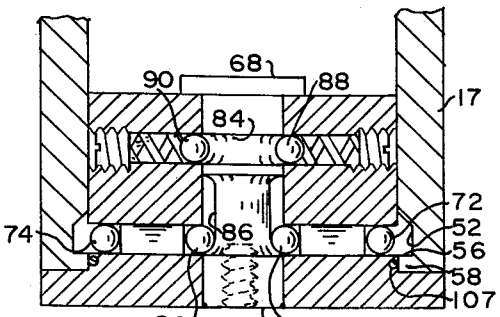
FIG. 7 is a sectional view of a portion of the cap shown in FIG. 6 with the cap unlocked to permit ejection.

Examining cap 44 in greater detail, reference is made to FIG. 6 which shows cap 44 in a locked position (also shown in FIG. 5) wherein the locking balls are urged into latching engagement with circular notch 52. Once pin 68 is pushed downward, it will be noted in FIG. 7 that cap 44 is in a position to be ejected from cylinder 17. Locking balls 72 and 74 are then urged inward by lip 58, and connecting pins and activating balls 80 and 82 are moved in such a way that balls 80 and 82 are pushed inward into the lower region of elongated groove 86 of activating pin 68. Detent balls 88 and 90 are urged into engagement with shallow groove 84 to thus hold pin 68 in the unlocked position. An "O" ring seal 107 normally seals between cap 44 and cylinder 17 to prevent entrance of water.

Once cap 44 is ejected, which will occur by virtue of air pressure which initially moved the piston down to unlock cap 44, piston 42 moves into essentially the same position originally occupied by cap 44 and is locked in that position by semicircular latches 108 (one of which is shown) pivotally attached at one end. Latches 108 are provided with a locking ear or tab 110 which extends through slot 112 and wall 114 of recess 116 formed in the lower end 118 of piston 42. Latch 108 is urged into engagement with wall 120 of cylinder 17 by compression spring 122 and slides down supported by the wall; and where the cap has existed, latches are urged outward into engagement with lower lip 58 of locking groove 52. When this occurs, port 124 is uncovered, and an open passageway exists between cylinder 17 through line 40 to bag 22.

For the operation of the weight ejection system, air is supplied by pressure tank 14 through first stage regulator 28. Check valve 125 is connected to an output of regulator 28 and polarized to permit flow from regulator 28. A length of line 127 connects the output of regulator 28 to control valve 128, and a line 129 connects from the output of control valve 128 to restricting orifices 132 and 134, contained in lines 136 and 138 which connect to top ends 139 of canisters 16 and 18. Line 127, in addition to interconnecting regulator 28 to control valve 128, functions as a reservoir of air pressure and has an internal volume of a capacity sufficient to provide an operating force to pistons 42 in cylinders 16 and 18 in the event pressure in tank 14 becomes exhausted or should fail. Typically, the volume of line 127 would be made sufficient to provide positive ejection of weights at the usual maximum depth achieved by sports divers, typically 100 to 200 feet. This length of line would thus have a volume at least equal to a volume when initially charged to a selected pressure and then expanded through valve 128 and lines 136 and 138; and the initial volume above pistons 42 will apply a force to these pistons which, when transmitted through weights 20 and/or dummy weights **20*a*, will apply a force to releasing pin 68 sufficient to release cap 44. Typically, however, the volume of line 127 will be such as to provide, additionally, sufficient air to not only effect release of the weights, but at least to partially inflate air bag 22. Most significantly, line 127 remains charged with an emergency source of air even if high pressure tank 14 and line 126 becomes exhausted. In fact, if due to slow leakage, pressure would tend to be released from line 127, line 127 would be recharged each time that tank 14 is recharged and would, thereafter, remain charged independent of tank 14**.

Figure 3:
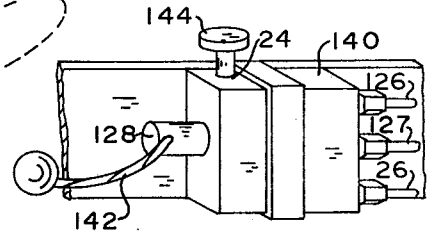
FIG. 3 is a pictorial illustration of the control valve employed in the operation of the system of this invention.

Valve housing 140, illustrated in FIG. 3, contains both control valve 128 and inflation valve 24. Thus, one can readily provide a little air to an air bag (in normal operation) or provide full emergency ascent with little effort. This valve assembly is typically worn on the diver at a position where it would be a rather natural movement to operate the valves of this assembly. Importantly, emergency valve 128 (e.g., a spool valve) is operated by cord assembly 142 which, when pulled, causes valve 128 to open and remain open. Separate operation of inflation valve 24 would be by operation of button 144, valve 24 being a momentary valve operating only when button 144 is pressed.

To place the system in operation, valve 30 at the outlet of tank 14 is opened and air is supplied through first stage regulator 28 and line 26 to valve 24 and to second stage regulator 36 to supply breathing air to mouthpiece 38. Air is also supplied to line 127 which becomes changed to the outlet pressure of regulator 28, typically 150 PSI.

In an emergency requiring immediate ascent, the diver would only pull cord assembly 142, which would operate open valve 128 (e.g., a slide valve which would remain open), and this would couple air from line 127 to cylinders 16 and 18. The rate of this air flow, and pressure buildup in cylinders 16 and 18, would be controllably stored by restrictive orifices 132 and 134 so that pistons 42 would eject weights 20 at such a rate as not to be dangerous. However, if there should be corrosion or dirt which would tend to bind the piston, weights or cap, the pressure would build up force as needed to release the weights under most conceivable conditions. Significantly, there is little clearance between piston 42, weights 20 and release pin 68, actually only sufficient for air pressure to develop opposite the full upper surface 148 of piston 42. Since only a slight downward movement of pin 68 is necessary to unlock cap 44, a sufficient volume of air can readily be stored in a relatively small length and volume of line 127. Upon the ejection of weights 20, piston 42 assumes a position at the bottom of cylinder 17, and air pressure available from tank 14 in cylinder 17 is applied through line 40 to air bag 22 to inflate it. Relief valve 36, operating at a pressure of 2–4 PSI, prevents a bursting pressure from being applied to air bag 22.

Upon the occurrence of the ejection of weights 20 and the filling of bag 22 (which would occur almost instantaneously), substantial buoyancy would be effected to positively lift a diver to the surface. However, even if only the weights are ejected in a situation where the diver's air supply has become exhausted, the ejection of weights should sufficiently change the diver's buoyancy to effect his ascent.

Clearly, the present invention provides means which lowers the risk of death of divers when found in an emergency wherein they must make rapid judgements and take sure and accurate actions to enable their ascent. However, in the event that a diver is unable to effect any action, as for example, where he becomes physically ill or is out of air and as a result stops breathing, such event would be detected by pressure sensor 150 which would provide an output proportional to pressure through valve 152, and the rate would be sensed by rate sensor 154. Rate sensor 154 includes means for providing an ouput when the rate drops below a predetermined rate, for example, two per minute. This output is supplied to solenoid 155, which in turn operated valve 128 to open it to thus automatically initiate the release of weights 20 and the inflation of bag 22. Alternately, the control responses and control devices would be pressure operated. Still alternately, an accummulator supplying air to the breathing mask (between regulator 36 and the interior of the breathing mask) would be monitored to sense a decrease in breath rate and effect operation of the control valve. Even in the event of a loss of air generally, the system will operate to release weight; and thus in most instances, it will provide positive buoyancy of the diver, assuring his ascent.

Having thus described my invention, what is claimed is:

1. Diving apparatus comprising:

a source of gas pressure;

a cylinder having an intermediate region between its ends for slidably holding weight means for effecting negative buoyancy comprising at least one weight member;

a piston normally positioned in one end of said cylinder;

a cap normally positioned in the opposite end of said cylinder and including releasing means responsive to a selected force applied by said piston through said weights for releasing said cap from the end of said cylinder; and normally closed valve means connecting said source of gas pressure and said one end of said cylinder;

whereby upon the operation of said valve means, pressure is applied to said one end of said cylinder, forcing said piston and weight member in said cylinder toward said opposite end of said cylinder and applying a pressure on said releasing means, whereby said cap and weight are ejected from said cylinder.

2. Diving apparatus as set forth in claim 1 including weight means slidably positioned in said cylinder and including at least one weight member, said weight means extending between and engaging said piston and said releasing means, whereby minimum movement of said piston will force said weight means against said releasing means and release said cap.

3. Diving apparatus as set forth in claim 2 further comprising sealing means for sealing between said piston and said cylinder, and means coacting between said piston and said cylinder for stopping the travel of said piston at said opposite end of said cylinder and for providing a pressure seal, closing said opposite end of said cylinder;

said source of gas pressure is a source of air pressure;

breathing means coupled to said source of pressure for enabling a diver to breathe air; and a check valve and a length of line connecting said check valve to said valve means, said length of line having a selected volume at least equal to a volume when, initially charged to a selected pressure and then expanded through said valve means to said piston, will apply to said piston and thereby to said releasing means a said selected force, said check valve being polarized to pass air only from said source of air pressure to said valve means, whereby air originally supplied by said source of air pressure through said check valve to said length of line is trapped, and thereafter a failure of said source of air pressure will not disable operation of said piston.

4. Diving as set forth in claim 3 wherein said normally closed valve is connected to said cylinder through a line having a restrictive orifice, whereby the rate of ejection of said weight member is controlled.

5. Diving apparatus as set forth in claim 4 further comprising manual means connected to said releasing cap for manually releasing said cap from said cylinder.

6. Diving apparatus as set forth in claim 4 further comprising:

an inflatable bag; and coupling means coupling said intermediate region of said cylinder to said air bag, whereby upon the operation of said valve means and travel of said piston to said opposite end of said cylinder, gas within said cylinder is coupled to said bag, inflating it.

7. Diving apparatus as set forth in claim 4 wherein said valve means includes manual opening means and means responsive to a stoppage of flow of air from said source of air pressure through said breathing means for longer than a selected time for operating open said valve means.

* * * * *